United States Patent [19]

Clayton et al.

[11] 4,415,087

[45] Nov. 15, 1983

[54] LAMINATED PRESSURE SENSITIVE ADHESIVE STRIP FOR USE IN PLASTIC BAGS

[75] Inventors: William J. Clayton, Fairport; William G. Outhouse, Victor, both of N.Y.

[73] Assignee: Mobil Oil Corporation, New York, N.Y.

[21] Appl. No.: 335,799

[22] Filed: Dec. 30, 1981

[51] Int. Cl.[3] ..... B65D 65/40

[52] U.S. Cl. ..... 206/632; 383/86

[58] Field of Search ..... 229/62, 485 A, 485 B; 206/613, 632; 428/35, 352; 156/315, 152, 344, 247; 150/3

[56] References Cited

U.S. PATENT DOCUMENTS

| | | | |
|---|---|---|---|
| Re. 28,969 | 9/1976 | Naito | 150/3 |
| 3,257,228 | 6/1966 | Reed | 229/485 B |
| 3,283,345 | 11/1966 | Berck | 5/471 X |
| 3,339,606 | 9/1967 | Kugler | 150/3 |
| 3,348,762 | 10/1967 | Kasinkas . | |
| 3,670,876 | 6/1972 | Davis | 206/58 |
| 4,186,786 | 2/1980 | Kirkpatrick | 150/3 |

*Primary Examiner*—Steven M. Pollard
*Assistant Examiner*—David Voorhees
*Attorney, Agent, or Firm*—A. J. McKillop; M. G. Gilman; J. F. Powers, Jr.

[57] ABSTRACT

An improved adhesive system for forming resealable channel closures for flexible bags such as thermoplastic bags made from polyethylene, e.g. sandwich bags. The adhesive system comprises a layer of hot melt adhesive over which a thin second layer of a liquid-based adhesive such as a water-based pressure sensitive acrylate is applied.

9 Claims, 3 Drawing Figures

LAMINATED PRESSURE SENSITIVE ADHESIVE STRIP FOR USE IN PLASTIC BAGS

BACKGROUND OF THE INVENTION

1. Field of the Invention

This invention relates to an improved adhesive system for use in sealing reclosable flexible bags such as thermoplastic bags made from polyethylene. Related applications assigned to the same assignee as this application include the following copending and concurrently filed applications: "Adhesive Bag Closure That Opens Easily By Hand But Resists Opening By Contents," Ser. No. 335,800, filed Dec. 30, 1981; "Protective Strip for Z-Fold Bag Closure," Ser. No. 335,955, filed Dec. 30, 1981, now U.S. Pat. No. 4,410,130; "Manufacturing Process For Channel Seal," Ser. No. 365,814, filed Apr. 5, 1982, now U.S. Pat. No. 4,392,897; and "Adhesive Channel Closure For Flexible Bags," Ser. No. 335,798, filed Dec. 30, 1981, the last application being incorporated by reference herein.

2. Description of the Prior Art

Plastic bags are used in a variety of household applications, especially those involving packaging and storing food items, e.g., sandwiches. The use of these bags for food packing and storing appears to have added an impetus to the search for better means of sealing such bags in such a way that the bags may be opened and then resealed. One area of development has included the so-called profile bags, an example of which may be seen by referring to U.S. Pat. Re. No. 28,969 to Naito. These profile bags have at least one set of mating channels which must be placed in registration before sealing can be effected. Such profile structures may be used to construct bags which are openable and resealable. As seen in U.S. Pat. No. 4,186,786 to Kirkpatrick, colored channels may allow the user to more easily detect complete occlusion of profiled bag openings. In order to form a seal, a profile channel must be placed in registration with its mating member, but this may be inconvenient for the user.

A second area of development is the use of adhesives to form resealable closures for bags. Usually one or more strips of adhesive are applied to one surface of a bag opening and sealing is effected by contacting the surface having the adhesive strip with a second surface on the opposite side of the bag opening. For example, U.S. Pat. No. 3,670,876 to Davis discloses a bag for household use including an improved closure comprising a plurality of pressure sensitive adhesive strips located in spaced apart relationship on an exterior portion of the bag. An offset flap portion is adapted to be folded over and attached to one or more of the adhesive strips to tightly close the bag.

While bags with adhesive closures have an advantage of being adjustable to the size of the object contained in the bag, it has been difficult to find a satisfactory adhesive which is suitable for use with reclosable plastic bags, such as those made of polyethylene film, which are packaged in a carton or on a roll. More particularly, an adhesive strip which adheres well to a polyethylene surface may form a seal that is not easily reopenable without destruction of the closure or a portion of the bag, while an adhesive that forms a resealable closure may not adhere well to a base film or closure strip. One test which is generally applied to products such as this is that the product must not deteriorate when subjected to a temperature of 140° F. for 24 hours.

Previous attempts at finding adhesives suitable for use in constructing resealable closures for flexible bags have involved two particular problems. First, while hot melt adhesives exhibit exceptionally high bond strengths when applied hot and are easy to apply at high speed without need of a drying step, the adhesive strength of a hot melt adhesive may build up on standing which leads to destruction of the closure upon opening. Also, the strength of a hot melt adhesive may be reduced after aging at 140° F. while in contact with polyethylene film (e.g. in a sealed position with an opposing surface of polyethylene film). Second, while liquid-based adhesives such as water-dispersions of acrylates do not suffer the disabilities of strength build up or deterioration with aging at 140° F. while in contact with polyethylene film, these water dispersions of adhesives do not form a satisfactorily permanent bond to polyethylene film; thus sections of an adhesive strip may be removed during opening of the bag leading to a deterioration of the seal after a number of openings and resealings. Other types of liquid-based adhesives such as those comprising organic solvents are difficult to use in a manufacturing process because of the requirement of a separate drying step and means to safely remove vapors generated thereby.

Processes have been tried to provide a closure in which the surface to which the adhesive is to be applied is pretreated so that the adhesive will more firmly adhere to the pretreated section to create an effective seal which is openable and resealable without deterioration of the seal or destruction of the closure. Pretreatment of polyolefins such as polyethylene has often involved an oxidizing step. U.S. Pat. No. 3,348,762 to Kasinkas, discloses a household bag on which an oxidized strip is formed across the upper closure flap on the surface. The oxidized strip is formed by a process in which a gap voltage generated in the air between an electrode and an area forming strip on a bag ionizes the ambient proximate thereto. The ionized ozone thus formed acts as an oxidizing agent, and oxidizes a strip across the upper closure flap on the surface beneath the electrode. A pressure sensitive adhesive is then applied to the oxidized area and dried. This type of oxidizing step, however, may be difficult to control from a manufacturing standpoint because undesired adhesion of film layers may occur, and it may be difficult to localize the area exposed to such an oxidizing step.

In the pressure sensitive adhesive art, the solution to the problem of sticking during shipment and storage has been to provide a release layer over the pressure sensitive adhesive. For example, pressure sensitive plastic tapes have a release layer which impedes the sticking of the adhesive to the plastic of the adjacent layer in the roll. This approach is not desirable for use on closures for plastic bags because of the expense and difficulty in manufacture.

Thus, it is an object of this invention to provide an adhesive system for a flexible bag which selectively adheres to one side of a closure structure. It is another object of this invention to provide a closure for a flexible bag which forms an effective seal but which is openable and resealable. It is yet another object of this invention to provide a closure for a flexible bag which closure comprises an easily manufacturable closure having an effective adhesive system. It is a further object to provide a resealable closure for a flexible bag comprising polyethylene in which the closure comprises a hot melt/acrylate adhesive system which is effective with a very thin layer of the acrylate component. These and other objects of the invention will be apparent from the following explanation.

SUMMARY OF THE INVENTION

The present invention provides an adhesive system suitable for use in forming resealable closures for flexible bags wherein the adhesive system comprises a first layer of a hot melt adhesive affixed to a base surface of the closure and a thin second layer of a liquid-based pressure sensitive adhesive, such as a water-based acrylate or a solvent-based adhesive, affixed to the first layer. A closure formed with the adhesive system of this invention provides a protected adhesive strip which selectively adheres more firmly to the base surface to which it was originally applied, thus providing a reopenable closure which can be sealed, opened and resealed without substantial loss of adhesive to the surface contacted by the adhesive portion of the closure. The protective channel structure of the closure keeps the outer layer of adhesive out of contact with other surfaces until sealing is effected.

In a preferred embodiment a polyethylene bag has applied thereto a separately extruded polyethylene channel strip having a layer of hot melt adhesive therein. A layer of water-based acrylate pressure sensitive adhesive in the form of a dispersion is applied over the layer of hot melt adhesive in the channel strip at a preselected thickness such that the thickness of the dried film is from 0.01 mil to about 0.05 mil.

DETAILED DESCRIPTION OF THE DRAWINGS

Figure 1:
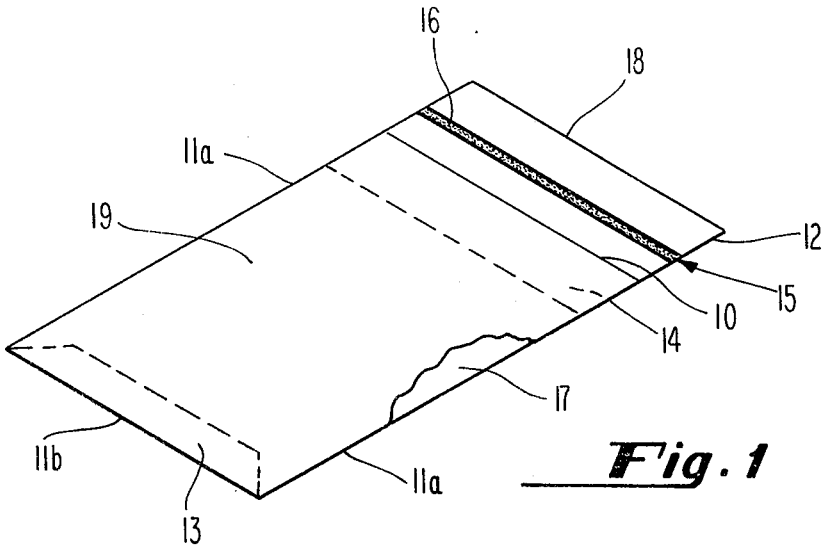
FIG. 1 is a perspective view of a bag constructed with a closure having an adhesive system made in accordance with this invention.

FIG. 1 shows a perspective view of a bag having a closure constructed with an adhesive system of this invention. The bag body has first wall 17 (shown in cutaway section) having a top edge 18, two sides, and a bottom portion; and a second wall 19 having a top edge 10, two sides, and a bottom portion, which is sealingly connected to the first wall along a major portion of the side edges and bottom portions shown as seal lines 11*a* and 11*b* to form an open topped bag body. Optionally, the bag body may be constructed with an internal fold of film 14 or a gusset 13 (shown in phantom). The top edge 18 of the first wall 17 extends beyond top 10 of the second wall 19 to define a closure flap 12. A channel strip 15 is positioned on flap 12. The channel strip may be formed as a separate structure and affixed to flap 12 or formed as an integral portion of flap 12, e.g. by a heat deformation process. A top view of the adhesive system 16 placed interior to channel 15 is also shown.

Figure 2:
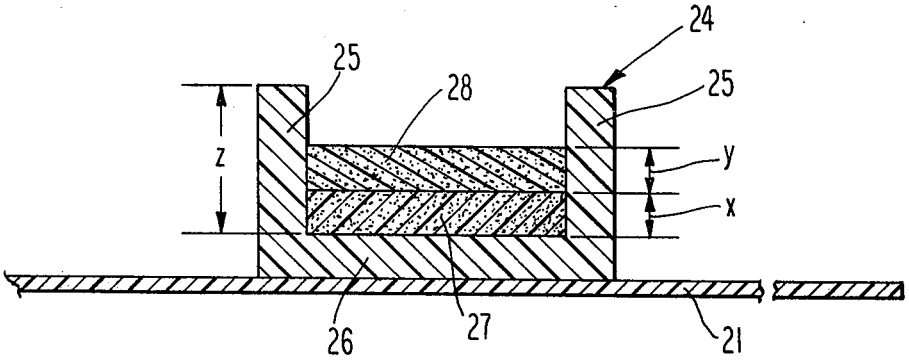
FIG. 2 is an enlarged cross-sectional view of a closure having an adhesive system made in accordance with this invention.

FIG. 2 is an enlarged cross-section of a sectional view of a film upon which a closure constructed with an adhesive system of this invention has been positioned. Film 21 which may be the flap of a bag body (not shown) has attached thereto a channel strip 24 having a trough, with channel strip 24 comprising a base portion 26, and channel walls 25, each of which walls has an interior height indicated as z. A first layer 27 of hot melt adhesive is applied within the trough and over base 26 with a thickness indicated by x. Preferably first layer 27 is a substantially continuous layer. A thin second layer 28 of a pressure sensitive liquid-based adhesive, e.g., a water based acrylate dispersion or a solution comprising toluene and an acrylate, is applied over first layer 27. The thickness of second layer 28 is indicated by y. Preferably second layer 28 is also substantially continuous. As will be explained below, it is also preferred that the liquid adhesive used to form second layer 28 be a water-based adhesive, e.g. a colloidal dispersion of an acrylate, to minimize manufacturing problems in disposing of vapors from organic solvents. The adhesive system of this invention allows a much reduced thickness of the second layer to be used and still achieve a satisfactory seal. Channel walls 25 keep the top outer layer of the adhesive system out of contact with other surfaces until sealing is effected. Sealing of the closure is effected by contacting the channel strip having the adhesive system therein with an opposite surface such as by closing the flap over the bag opening. By exerting pressure along the channel strip the adhesive is contacted with the surface and sealing is accomplished.

Figure 3:
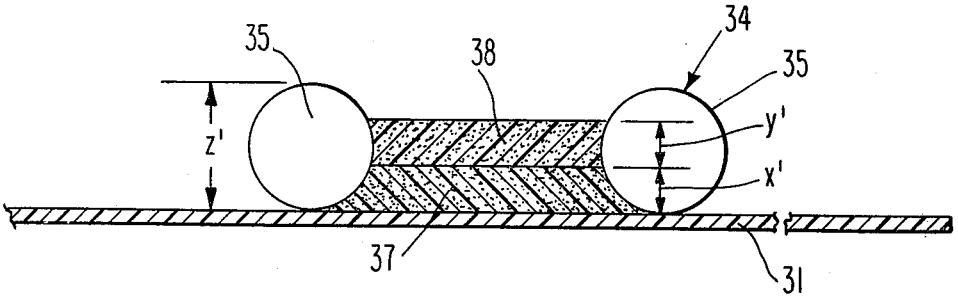
FIG. 3 is an enlarged cross-section of an alternate embodiment of a closure having an adhesive system made in accordance with this invention.

FIG. 3 is an enlarged cross-section of an alternate embodiment of a closure having an adhesive system of this invention. In this embodiment channel strip 34 has been constructed with a trough structure by affixing two beads 35 a preselected distance apart on a film 31. Each bead has a height indicated generally as z′, although the height along the length of the bead may vary somewhat. A first layer 37 of a hot melt adhesive is applied within the trough to a portion of film 31, which portion is between beads 35. The thickness of first layer 37 is indicated as x′. Preferably first layer 37 is substantially continuous and covers the entire portion of film 31 which lies between beads 35. A second layer 38 of a liquid adhesive is applied on top of first layer 37 and with a thickness indicated as y′.

While a range of thickness may be used for x, y, x′ and y′ it is preferred that thicknesses be chosen such that $x+y<z$ and $x'+y'<z'$. In other words, the combined thickness of the first and second layers should be less than the depth of the channel strip or the interior height of its walls. This allows the ribs or walls of the channel structure to keep the surface of the adhesive strip out of contact with other surfaces until sealing is desired. By constructing a bag closure in accordance with the adhesive system of this invention, it is also possible to use very thin thicknesses of the liquid-based adhesive such as from 0.01 to about 0.05 mils for the dried film of the second layer.

Liquid adhesives suitable for forming adhesive systems of this invention include solvent-based adhesives (an adhesive substantially dissolved in a solvent) and water-based dispersions. Examples of such adhesives include water dispersions of acrylates, solutions of aromatic hydrocarbons (e.g. toluene) and acrylates, and rubber latex.

The adhesive system should be selected according to the material comprising the bag. For a bag comprising polyester an adhesive system comprising a first layer of hot melt adhesive and a second layer comprising rubber latex is suitable. For a flexible bag comprising polyethylene it is preferred to use a water-based pressure sensitive adhesive applied in the form of a colloidal dispersion. The use of this water-based dispersion reduces or eliminates the problems attendant to evaporating and removing organic solvent vapors, and drying may be allowed to occur in the packaged product.

One of the important features of this invention is that it allows a water-based acrylate pressure sensitive adhesive to be used with polyethylene film. While such adhesives have very desirable properties and are easier to use from a processing standpoint, heretofore such water-based adhesives have not been very effective in forming seals for polyethylene bags in which a lasting and resealable closure was desired.

In a particularly preferred embodiment for a bag and channel strip comprising polyethylene, an acrylate adhesive is used as the pressure sensitive adhesive second layer and is applied as a water-based dispersion having about 10% solids over the hot melt adhesive first layer. This preferred adhesive system may be formed by extruding a hot melt pressure sensitive adhesive (IP84008 from Swift Adhesives and Coatings) through a slot die and applying the adhesive within an extruded channel strip of the type seen in FIG. 2 to a trough surface to form a first layer about 1.5 mils thick. This first layer should be immediately overcoated with a second layer comprising a 10% solids water-based acrylate adhesive (made by diluting Adhesive 72-9292 from National Adhesives with water) applied in a thickness of about 0.016 mils (e.g. at a rate of about 0.4 grams per 60 feet over an area about $\frac{1}{8}$ inch wide).

Various compositions comprising polyethylene, copolymers and terpolymers comprising polyethylene, and additives thereto may also be used, e.g., additives to enhance the stickiness of a polyethylene channel to a polyethylene film bag body. A preferred channel strip for forming a closure in the above explained, particularly preferred embodiment having the adhesive system of this invention comprises 83% polyethylene and 17% ethylene vinyl acetate, and has a width of about 3/16 inch and a height of about 50 mils. It is also preferred to add a coloring agent to the strip so that the closure may be more easily located visually.

While various embodiments of this invention have been described other variations may be developed by those skilled in the art which are within the spirit and scope of the invention.

What is claimed:

1. A resealable closure suitable for use with a flexible bag said closure comprising a channel strip and an adhesive system within said channel strip, said adhesive system comprising a first layer of hot melt adhesive and a thin second layer of a liquid-based pressure sensitive adhesive applied over said first layer such that the combined thickness of said first layer and said second layer is less than the interior height of the channel walls.

2. The resealable closure of claim 1 wherein said liquid-based pressure sensitive adhesive comprises a water-based acrylate.

3. The resealable closure of claim 1 wherein said liquid-based pressure sensitive adhesive comprises a solvent-based adhesive.

4. The resealable closure of claim 2 wherein the thickness of said second layer is from 0.01 to about 0.05 when dry.

5. A resealable flexible bag comprising a first wall having a top edge, two sides and a bottom portion, a second wall having a top edge, two sides and a bottom portion, wherein said first wall and said second wall are sealingly attached along a major portion of said side edges and said bottom portions to form an open-topped bag body, said top edge of said first wall extending beyond said top edge of said second wall to define a closure flap, the upper face of said flap having a channel strip a predetermined distance from the top edge of said first wall, said channel strip having contained therein an adhesive system comprising a first layer of hot melt adhesive and a thin second layer of a liquid-based pressure sensitive adhesive applied over said first layer.

6. The resealable bag of claim 5 wherein said liquid-based pressure sensitive adhesive comprises a water-based acrylate.

7. The resealable bag of claim 5 or 6 in which said bag and said channel strip comprises a major portion by weight of polyethylene.

8. The resealable bag of claim 5 wherein said liquid-based pressure sensitive adhesive comprises a solvent-based adhesive.

9. A resealable flexible bag comprising a first wall having a top edge, two sides and a bottom portion, a second wall having a top edge, two sides and a bottom portion, wherein said first wall and said second wall are sealingly attached along a major portion of said side edges and said bottom portions to form an open-topped bag body, said top edge of said first wall extending beyond said top edge of said second wall to define a closure flap, an adhesive system affixed to one of an outer surface of said second wall or said flap at a preselected distance from said opening, said adhesive system comprising a first layer of hot melt adhesive and a thin second layer of a liquid-based pressure sensitive adhesive applied over said first layer, said liquid-based pressure sensitive adhesive comprising a water-based acrylate or a solvent-based acrylate, said adhesive system being contained in a channel strip.

* * * * *